United States Patent [19]

Karlsson

[11] Patent Number: 4,942,674

[45] Date of Patent: Jul. 24, 1990

[54] METHOD IN THE DRYING OF A PAPER WEB OR EQUIVALENT

[75] Inventor: Markku Karlsson, Turku, Finland

[73] Assignee: Valmet Paper Machinery Inc., Finland

[21] Appl. No.: 313,133

[22] PCT Filed: May 24, 1988

[86] PCT No.: PCT/FI88/00078

§ 371 Date: Jan. 24, 1989

§ 102(e) Date: Jan. 24, 1989

[87] PCT Pub. No.: WO88/09845

PCT Pub. Date: Dec. 15, 1988

[30] Foreign Application Priority Data

Jun. 4, 1987 [FI] Finland ..... 872504

[51] Int. Cl.[5] ..... F26B 7/00

[52] U.S. Cl. ..... 34/18; 34/41; 34/60; 34/156; 226/97

[58] Field of Search ..... 34/4, 41, 23, 155, 156, 34/18, 60, 242; 226/97; 68/5 E, 5 D

[56] References Cited

U.S. PATENT DOCUMENTS 3,720,002 3/1973 Martin ..... 34/41 X 4,594,795 6/1986 Stephansen ..... 34/4 X

*Primary Examiner*—Henry A. Bennet

*Assistant Examiner*—John Sollecito

*Attorney, Agent, or Firm*—Steinberg & Raskin

[57] ABSTRACT

A method for contact-free drying of a paper or board web (W). Both in which both infrared radiation and drying air jets are used for drying, by means of which air jets the web (W) passing through the dryer (10,20) is, at the same time, supported free of contact. The web (W) is passed first into an infrared drying gap or gaps (10$V_A$,10$V_B$) and thereupon into a flotation web-drying gap (20V). The infrared radiators (105) in the infrared drying unit or units (10A,10B) are cooled by means of air currents ($F_{Ain}$,$F_{Bin}$). In the method, before the flotation dryer (20), and in such a way closed infrared drying unit or units (10A,10B) is/are used whose cooling air is not to a significant extent passed into the infrared drying gap (10$V_A$,10$V_B$). The dry cooling air heated in the infrared drying unit or units (10A,10B) is passed through the nozzles (25$_1$,25$_2$) of the airborne dryer (20) following after the infrared dryer so as to constitute drying and/or airborne air blowings in its drying gap (20V).

8 Claims, 2 Drawing Sheets

METHOD IN THE DRYING OF A PAPER WEB OR EQUIVALENT

BACKGROUND OF THE INVENTION

The invention concerns a method for contactfree drying of a paper or board web, in which method both infrared radiation and drying air jets are used for drying, by means of which these air jets the web passing through the dryer is, at the same time, supported free of contact, preferably from two sides, in which method the web is passed first into an infrared drying gap or gaps and thereupon into an airborne web-drying gap, and in which method the infrared radiators in the infrared drying unit or units are cooled by means of air currents.

The present invention relates to the drying of a paper web, board web, or of any other, corresponding moving web. A typical application of the invention is the drying of the paper web in connection with its coating or surface-sizing.

As is known in prior art, paper webs are coated either by means of separate coating devices or by means of on-machine devices integrated in paper machines or by means of surface-sizing devices, which operate in the drying section of a paper machine so that the web to be coated is passed, at the final end of a multi-cylinder dryer, to a coating device, which is followed by an intermediate dryer and finally, e.g., by one group of drying cylinders as an after-dryer. A typical application of the present invention is the said intermediate dryer placed after a coating device, to which the invention is, however, not confined.

In prior art, so-called airborne web dryers are known, wherein a paper web, board web or equivalent is dried free of contact. Airborne web dryers are used, e.g., in paper coating devices after a blade, roll or spread coater to support and to dry the web that is wet with the coating agent, free of contact. In airborne web dryers, different blow nozzles for the supporting and drying air as well as arrangements of same are applied. Said blow nozzles can be divided into two groups, i.e. positive-pressure or float nozzles and negative-pressure or foil nozzles, both of which can be applied in the method of the present invention.

The prior-art airborne web dryers that are used most commonly are based exclusively on air blows. It is partly for this reason that the airborne web dryer becomes quite spacious, because the distance of effect of the airborne web dryer must be relatively long in order that a sufficiently high drying capacity could be obtained. Another reason for these drawbacks is that in air drying the depth of penetration of the drying remains relatively low.

In the prior art, different dryers are known which are based on the effect of radiation, in particular of infrared radiation. The use of infrared radiation provides the advantage that the radiation has a relatively high depth of penetration, which depth of penetration is increased when the wavelength becomes shorter. The use of infrared dryers in the drying of paper webs has been hampered, e.g., by the risk of fire, because the temperatures in infrared radiators become quite high, e.g. 2000° C., in order that a drying radiation with a sufficiently short wavelength could be achieved.

Electric infrared dryers as separate or as exclusively used are also energy-economically unfavourable owing to the relatively high cost of electric energy, as compared, e.g., with natural gas.

In paper coating stations, including on-machine coating stations, separate infrared dryers have been used whose drying is based exclusively on the radiation effect. However, by means of these infrared dryers, a sufficiently good adjustability of paper quality and evaporation has not been obtained. Moreover, the drying process becomes highly dependent on the operational quality of the infrared dryer.

SUMMARY OF THE INVENTION

The object of the present invention is a further development of the method and the device described in the applicant's Finnish patent application 862427 in on-machine coating-drying of a paper web or equivalent. In the method described in said Finnish application, it is considered novel that in the method the moving web is first passed into an infrared drying gap, in which a drying-energy pulse of relatively short duration is directed at the web, the power of said energy pulse being substantially higher than the average drying power of the dryer per unit of area, and that air is brought into the infrared unit, which air, having been heated in the infrared unit, is passed as replacement air and/or drying air for the airborne web-drying unit or units placed after the infrared unit.

The aforesaid Finnish application further discloses a drying device intended for carrying out the method, which device comprises an infrared drying unit and and airborne web-drying unit or airborne web-drying units, which said infrared drying unit comprises a series of infrared radiators and an infrared treatment gap fitted in its connection, through which said gap the web to be dried can be passed, and which said airborne web-drying unit or units comprise a box portion, inside of which a nozzle box or boxes are fitted, in connection with which there are nozzle parts, through which drying and supporting air jets are applied to the web to be dried, which device comprises an infrared drying unit and an airborne web-drying unit, which are integrated with each other both structurally and functionally, and which infrared unit is placed, in the direction of running of the web to be dried, immediately before the airborne web-drying unit.

In the device in accordance with the above mentioned Finnish patent application 862427, it is considered novel that the infrared drying unit comprises air and nozzle devices, through which air flows can be passed into the treatment gap of the infrared unit and/or into connection with the heated parts of the infrared unit, which said air flows are passed for replacement and/or drying air for the subsequent airborne web-drying unit or units.

In addition to the above Finnish application, a starting point of the present invention has been a prior-art infrared dryer wherein the cooling air of the infrared radiators is not blown into contact with the web in its treatment gap, but the circulation of the cooling air in the infrared units is closed. In these prior-art infrared dryers, the cooling air has been blown directly out, or part of its heat content has been recovered by means of heat exchangers and used, e.g., for heating of AHR water.

A particular object of the present invention is a further development of the method and the device in accordance with said Finnish patent application 862427 in such a way that an improved efficiency of drying is obtained. As compared with the dryers based exclusively on infrared radiators, an object of the present invention is to provide an improved evaporating capacity, reduced spreading of moisture to the environment, and better adjustability of the drying.

The airborne web dryer to be applied in the invention has no circulation of air, but the supporting and drying blows of air passed through the nozzles into contact with the web are collected in boxes and sucked out of the airborne web dryer.

In the invention, it is an essential advantage in view of its operation that by means of the infrared units, a considerable amount of drying energy can be "charged" into the web to be dried within a relatively short drying distance, the cooling air produced in connection with said production of drying energy being recovered and the web being passed to the airborne web dryer, which follows substantially immediately thereafter, wherein the water vaporized by the infrared dryer is "washed" out of the web by means of said dry and heated drying air. What is achieved hereby is improved evaporation capacity, improved operability of the dryer, and the fact that the moisture evaporated out of the web cannot spread into the machine hall.

The operability of the method of the invention is also increased thereby that, by means of the infrared units, the drying capacity can be regulated advantageously both in the longitudinal direction and in the transverse direction of the web by means of electric power regulation apparatuses. The method of the invention is "self-adjusted" in that the thicker the web that is being dried, the more electric power is required in the infrared dryer and the more cooling air is produced, the production of cooling air being, thus, as a rule, in accordance with the requirement of cooling air.

In view of achieving the objectives given above and those that will come out later, the invention is mainly characterized in that in the method, before the airborne web dryer, and in such a way closed infrared drying unit or units is/are used whose cooling air is not, at least not to a substantial extent, passed into the infrared drying gap, and that the dry cooling air heated in said infrared drying unit or units is passed through the nozzles of the airborne web dryer following after the infrared dryer so as to constitute drying and/or airborne air blowings in its drying gap.

In the present invention, the infrared drying unit or units are connected with an airborne web dryer, in which, as the drying and supporting air, the cooling air of the infrared radiators and of other parts placed at their proximity is utilized, which said cooling air is particularly suitable for drying air, because dry and hot air is concerned. In the present invention, a fitting together of an infrared unit and an airborne web dryer is accomplished advantageously, in particular in view of energy economy.

BRIEF DESCRIPTION OF THE DRAWINGS

In the following, the invention will be described in detail with reference to an exemplifying embodiment of the invention shown in the figures in the accompanying drawing, the invention being not confined to the details of said embodiment.

DESCRIPTION OF THE PREFERRED EMBODIMENT

Figure 1:
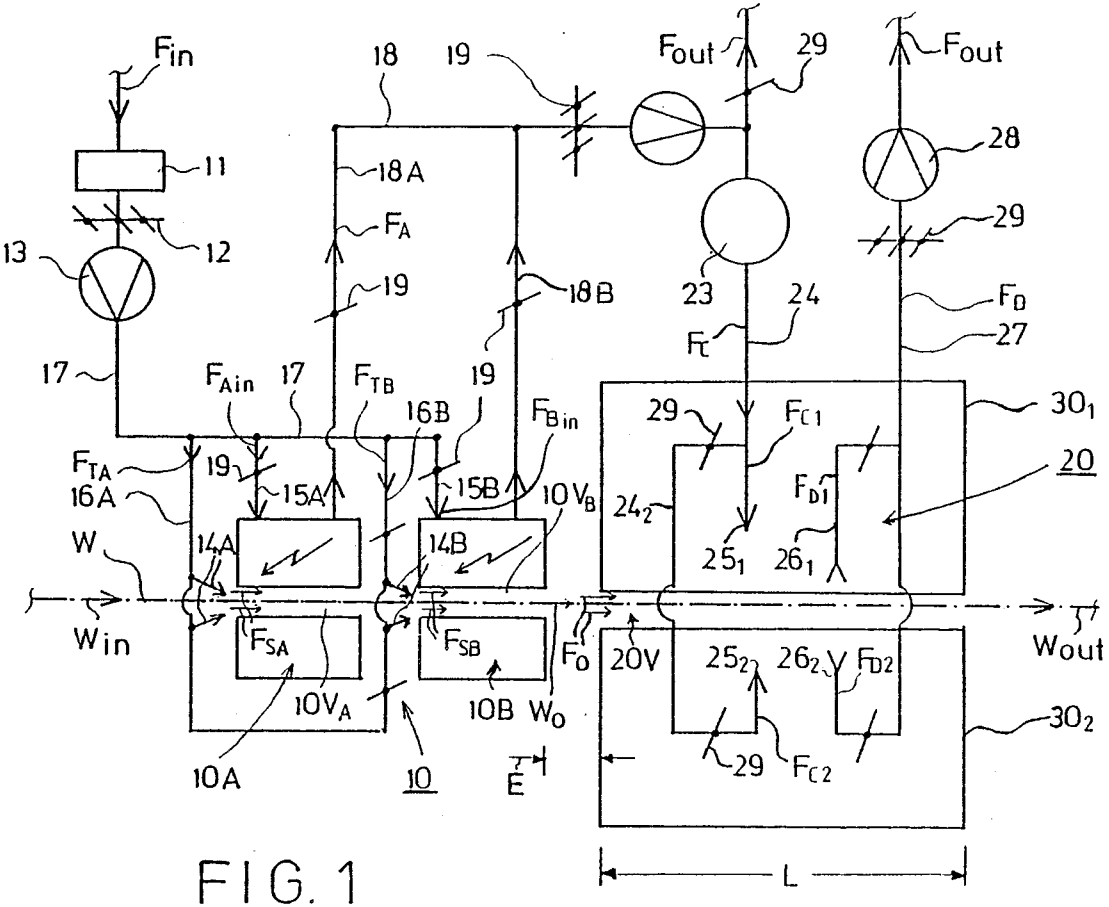
FIG. 1 is a schematical illustration of an infrared-airborne web dryer in accordance with the invention.
Figure 2:
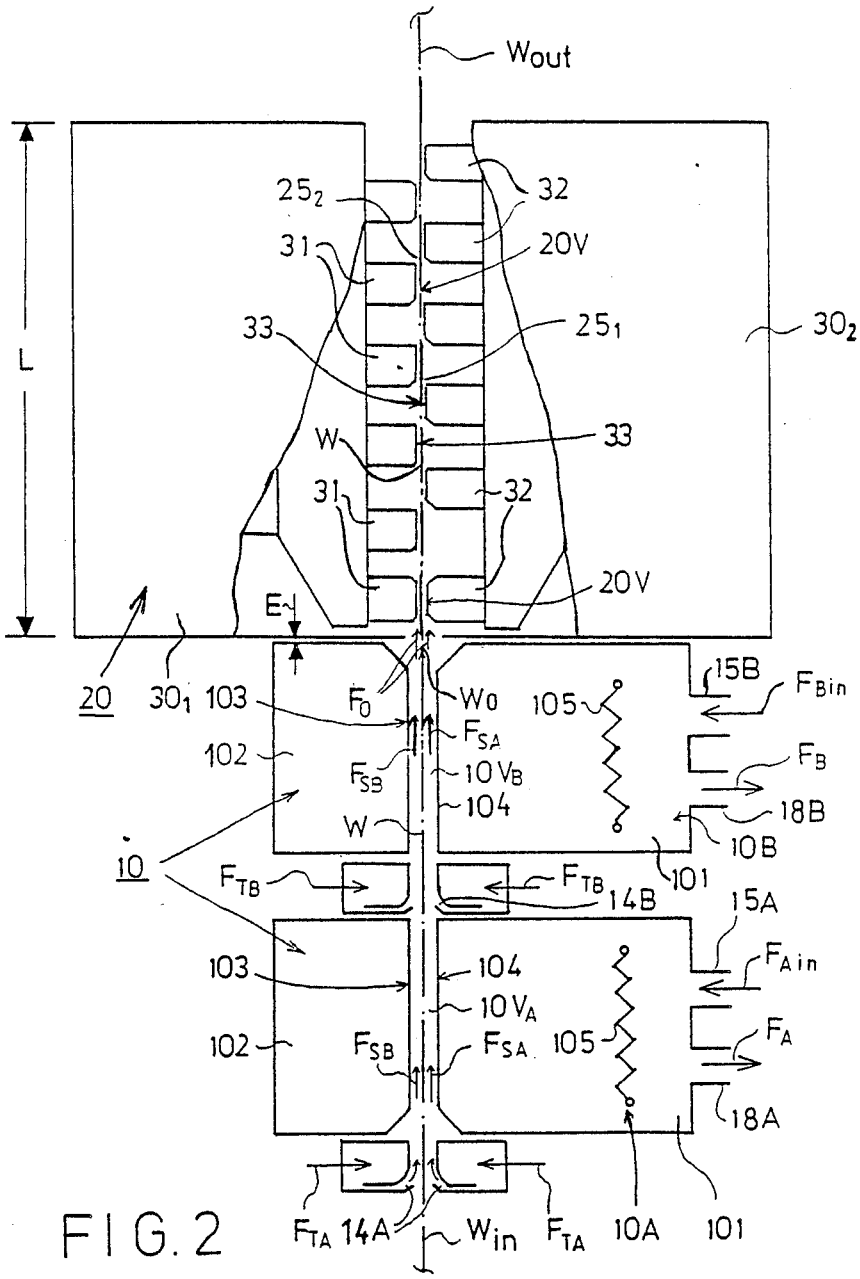
FIG. 2 is a more detailed view of the construction of an apparatus that makes use of the invention, in which said apparatus the web runs vertically from the bottom to the top.

The combined infrared-airborne web dryer shown in FIGS. 1 and 2 comprises an infrared dryer 10, which comprises two infrared drying units 10A and 10B placed one after the other, the paper web W running through the treatment gaps $10V_A$ and $10V_B$ in said units. The infrared units 10A,10B are followed, substantially immediately or after a short gap E, by the airborne web dryer 20, through whose treatment gap 20V the web W runs, said web W being supported free of contact and dried at the same time. The run of the web W through the infrared-airborne web dryer is illustrated by means of a dotted-dashed line $W_{in}-W_{out}$.

The infrared units 10A and 10B are electrically operating units in themselves known, which are provided with an upper radiation unit 101 and an opposite counterreflection unit 102, which returns the radiation that has passed through the web W into the treatment gap $10V_A$ and $10V_B$. The electrically operating infrared radiators 105 of the infrared units 101 must be cooled so that their temperature should not become excessively high in view of their durability. The cooling air is introduced through a duct 17, which comprises, in the direction of arrival $F_{in}$ of the air, first a filter unit 11, a regulating grating 12, and a blower 13. The air inlet duct 17 communicates, via the ducts 16A and 16B, with the nozzle units 14A and 14B, through which accompanying flows $F_{SA}$ and $F_{SB}$ are blown into the treatment gaps $10V_A$ and $10V_B$ at both sides of the web W to be dried. In the nozzle units 14A and 14B, which precede the infrared units 10A and 10B, the blow nozzles consist of coanda nozzles, which are followed by carrier faces, between which the web W runs while carried by the accompanying blowings $F_{SA}$ and $F_{SB}$ in a stable way.

According to FIG. 1, the run of the web W is horizontal as it runs first through the treatment gaps $10V_A$ and $10V_B$ in the infrared units 10A and 10B and thereupon through the treatment gap 20V in the flotation web dryer 20.

According to FIG. 2, the run $W_{in}-W_{out}$ of the web is vertical from the bottom to the top. As is shown in FIG. 2, the infrared units 10A and 10B are provided with a radiation window 104 and, at its opposite side in the units 102, with a reflecting face 103, which is parallel to the plane of the radiation window 104. The parallel plane parts 103 and 104 define treatment gaps $10V_A$ and $10V_B$. The cooling air to be blown into the radiation units 101 is not blown into the treatment gaps $10V_A$ and $10V_B$, but the circulation of the cooling air is in this respect closed. The cooling air heated in connection with the radiators 105 in the units 101 is taken out of the units 101 through the air ducts 18A and 18B as flows $F_A$ and $F_B$. The air system includes regulating valves and gratings 19, by means of which the quantities of air can be set and adjusted. The flows $F_A$ and $F_B$ are connected to the duct 18 and, being sucked by the blower 21, are passed into the duct 22, which is provided with a branch part **22*a*, through which, if necessary, any air that is excessive for the airborne web dryer 20** can be blown as a flow $F_{out1}$ out of the infrared-airborne dryer.

The duct 22 passes to the inlet-air side of the gas burner 23. The gas burner 23 is frequently not necessary, but, as a rule, the cooling air from the infrared dryer 10 is sufficient as inlet air for the flotation web dryer 20. Through the duct 24, the flows $FC_1$ and $FC_2$ are passed into the nozzles $25_1$ and $25_2$ in the nozzle boxes 31 and 32, and through them into the treatment gap 20V to both sides of the web W to constitute drying and supporting air in the flotation web dryer 20. From the treatment gap 20V the cooled and moistened air is taken through the ducts $26_1$ and $26_2$ as flows $F_{D1}$ and $F_{D2}$, and the exhaust air is collected into the duct 27. The flotation web dryer 20 consists of boxes $30_1$ and $30_2$ placed at opposite sides of the web W. As is shown in FIG. 2, in the interior of said boxes, there are nozzle boxes 31 and 32 placed alternatingly one after the other in the direction of run of the web W. The nozzle boxes 31,32 are provided with plane carrier faces, which act either as pressurized carrier faces or as carrier faces with negative pressure, to which the drying and supporting blowings $F_{C1}$ and $F_{C2}$ are passed through nozzles, preferably coanda nozzles $25_1$ and $25_2$. The flows $F_{D1}$ and $F_{D2}$ are taken from the gaps between the nozzle boxes 31 and 32, said flows being collected from the interior of the boxes 31 and 32 into the duct 27.

The airborne web dryer 20 is in such a way closed that replacement air need not be passed into it. The moist and cooled air is passed as the flow $F_D$ through the regulation grating 29 to the suction side of the exhaust air blower 28, and from the pressure side of the blower 28 the air is blown out as the flow $F_{out}$. The length E of the gap between the infrared dryer 10 and the flotation web dryer 20 is not critical in the invention, but the dryers 10 and 20 are placed preferably as close to each other as possible, so that at least part of the accompanying blows $F_{SA}$ and $F_{SB}$ warmed up in the treatment gaps $10V_A$ and $10V_B$ in the units 10A and 10B follow along with the web W on its run $W_o$, passing with the web W into the treatment gap 20V in the airborne web dryer 20. These flows are illustrated by the arrows $F_o$.

According to FIG. 1, cold air brought through the inlet duct 17 is passed through the ducts 16A and 16B to constitute accompanying blowings $F_{SA}$ and $F_{SB}$ for the web $W_{in}$. Another, alternative possibility is to take the air flows for said accompanying blowings out of the air duct 18 or ducts 18A and/or 18B, in which dry air warmed up in the infrared units 10A and 10B flows.

In the infrared units 10A and 10B, a drying-energy pulse of relatively short duration is directed at the web W, the power of said energy pulse being preferably substantially higher than the average drying power of the dryer per unit of area. The water vaporized by this energy pulse in the web W is liberated from the web W mainly only in the drying gap 20V in the flotation web dryer 20, where the web is washed, while being at the same time supported, by means of dry air jets.

Above, the details of the constructions of the infrared dryer 10 and of the flotation web dryer 20 are not described in very high detail, but, if necessary, they come out, e.g., from the applicant's said Finnish patent application 862427. The length L of the airborne web dryer 20 is determined mainly in accordance with the drying requirement and in accordance with the amount of cooling air that is produced by the preceding airborne units 10A and 10B.

In FIG. 1, two infrared units 10A and 10B placed one after the other are shown. It is understood that, within the scope of the invention, there may be only one infrared unit, or more than two subsequent units may be used.

In the following, the patent claims will be given, whereat the various details of the invention may show variation within the scope of the inventive idea defined in said claims and differ from the details given above for the sake of example only.

What is claimed is:

1. A method for contact-free drying of a paper or board web, said method comprising the steps of:

passing said web first through an infrared drying gap bound by two infrared drying units wherein at least one of said infrared drying units contains means for circulating cooling air such that substantially none of said cooling air passes into said infrared drying gap;

then passing said web through a flotation web drying gap bound by two flotation web drying units while simultaneously passing said cooling air from said at least one of said infrared drying units into at least one of said flotation web drying units and then into said flotation web drying gap.

2. The method of claim 1, wherein said web passes through said gaps without contacting any of said drying units.

3. The method of claim 1, further comprising passing said cooling air through a heating apparatus after it leaves said at least one of said infrared drying units and before it enters said at least one of said floatation web units.

4. The method of claim 1, further comprising providing a supporting blow air means for impinging air upon said web in at least one of said infrared drying units, said supporting blow air means being connected to an inlet for said cooling air in at least one of said infrared drying units.

5. The method of claim 1, further comprising providing a supporting blow air means for impinging air upon said web, said supporting blow air means being connected to an outlet for said cooling air in at least one of said infrared drying units.

6. The method of claim 1, further comprising regulating the flow of said cooling air from said at least one of said infrared drying units to said at least one of said flotation web drying units.

7. The method of claim 1, further comprising regulating drying capacity by regulating electric power supplied to said at least one of said infrared drying units.

8. The method of claim 7, further comprising variably regulating said drying capacity by directing at said web pulses of relatively short duration and higher than average drying capacity.

* * * * *